US005775884A

United States Patent [19]

Westmoreland et al.

[11] Patent Number: 5,775,884

[45] Date of Patent: Jul. 7, 1998

[54] MODULAR PUMP ASSEMBLY

[75] Inventors: Dennis F. Westmoreland, Snyder; Mark V. Zeck, Hermleigh, both of Tex.

[73] Assignee: Y-Z Industries Sales, Inc., Snyder, Tex.

[21] Appl. No.: 668,857

[22] Filed: Jun. 24, 1996

[51] Int. Cl.[6] ..... F04B 9/02

[52] U.S. Cl. ..... 417/383; 417/454

[58] Field of Search ..... 417/383, 454

[56] References Cited

U.S. PATENT DOCUMENTS

| | | | |
|---|---|---|---|
| 2,871,789 | 2/1959 | Kiffer et al. | 417/383 |
| 2,919,650 | 1/1960 | Wiggeman | 417/383 |
| 4,594,057 | 6/1986 | Morgan | 417/383 |
| 5,032,063 | 7/1991 | Zeck et al. | 417/383 |
| 5,332,372 | 7/1994 | Reynolds | 417/393 |

FOREIGN PATENT DOCUMENTS

| | | | |
|---|---|---|---|
| 1102008 | 4/1955 | France | 417/383 |

*Primary Examiner*—Timothy Thorpe
*Assistant Examiner*—Cheryl J. Tyler
*Attorney, Agent, or Firm*—David H. Judson

[57] ABSTRACT

The present invention discloses a modular diaphragm cartridge for use with a pump assembly. A cartridge body defines an interior chamber into which a piston is slidably connected. A spring biases the piston against a diaphragm placed over the end of the cartridge body to enclose the interior chamber. An end cap which threadedly engages the cartridge body to enclose the diaphragm between the end cap and body. The modular diaphragm cartridge may be removed from a pump housing as a single unit without the need for keeping track of multiple pieces. The present invention further discloses a modular inlet valve assembly, outlet valve assembly and plunger seal/guide cartridge.

6 Claims, 3 Drawing Sheets

MODULAR PUMP ASSEMBLY

TECHNICAL FIELD

The present invention relates to pumping assemblies, and more particularly to a pumping assembly including modular components for the diaphragm and check valve assemblies.

BACKGROUND OF THE INVENTION

A major problem with presently existing pump assemblies arises from the large number of components within the subassemblies comprising the pump assembly. This problem is especially prominent in situations involving the field maintenance of pump assemblies. During field maintenance procedures, when a component related to either the diaphragm assembly or the check valve assembly must be changed, a large number of parts, several under spring tension, must be taken apart and kept track of under less than ideal conditions. This problem is made worse in situations where the pump has been in use for a period of time and the fluids flowing through the pump run out and onto any removed parts making them even more difficult to handle. Also, if a toxic or pungent fluid flows through the pump, the smell and toxicity of the fluid can harm the individual performing field maintenance.

During field maintenance procedures if a single part is lost, a great deal of time may be lost while finding and replacing the lost part if the maintenance operator does not have a replacement part with him. Furthermore, the number of man hours involved in reinserting a number of small parts held in place by spring tension can become significant. Therefore, a design of pump assembly is needed that simplifies the field maintenance procedures involved in changing various components of the pump assembly.

BRIEF SUMMARY OF THE INVENTION

The present invention overcomes the foregoing problems with a pump assembly having modular diaphragm and check valve cartridges. The invention includes a pump housing defining a number of chambers for receiving modular assemblies that threadedly engage the housing as a single unit. Specifically, the housing is adapted to receive modular diaphragm and check valve cartridges that may be inserted and removed as a single unit.

The diaphragm cartridge unit consists of a cartridge body defining an interior chamber for containing a biased piston assembly. A diaphragm covers the chamber and is held between the cartridge body and an end cap. The end cap threadedly engages the end of the cartridge body on which the diaphragm is located. A piston slidably engages with the interior chamber of the cartridge body and a spring biases the piston and the diaphragm against the cap such that inlet and outlet ports defined in the cap are closed. Assembly of the modular diaphragm cartridge may take place in a controlled assembly environment and then be inserted into the pump housing at a field location as a single piece unit to ease field maintenance procedures.

The foregoing has outlined some of the more pertinent aspects of the present invention. These aspects should be construed to be merely illustrative of some of the more prominent features and applications in the invention. Many other beneficial results can be attained by applying the disclosed invention in a different manner or modifying the invention as will be described. Accordingly, other aspects and a fuller understanding of the invention may be had by referring to the following detailed description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION

Figure 1:
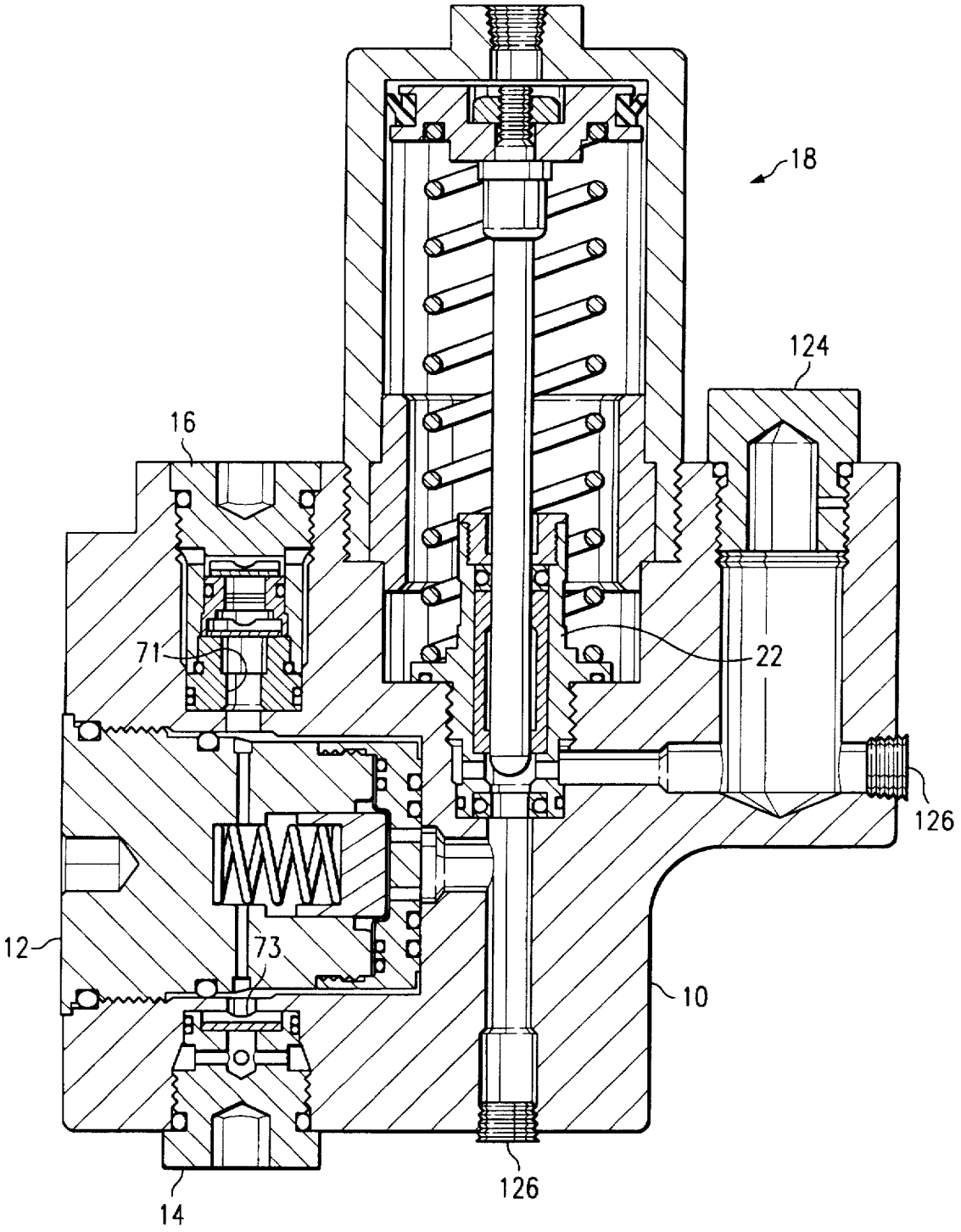
FIG. 1 is a cross sectional view of the modular pump assembly.
Figure 2:
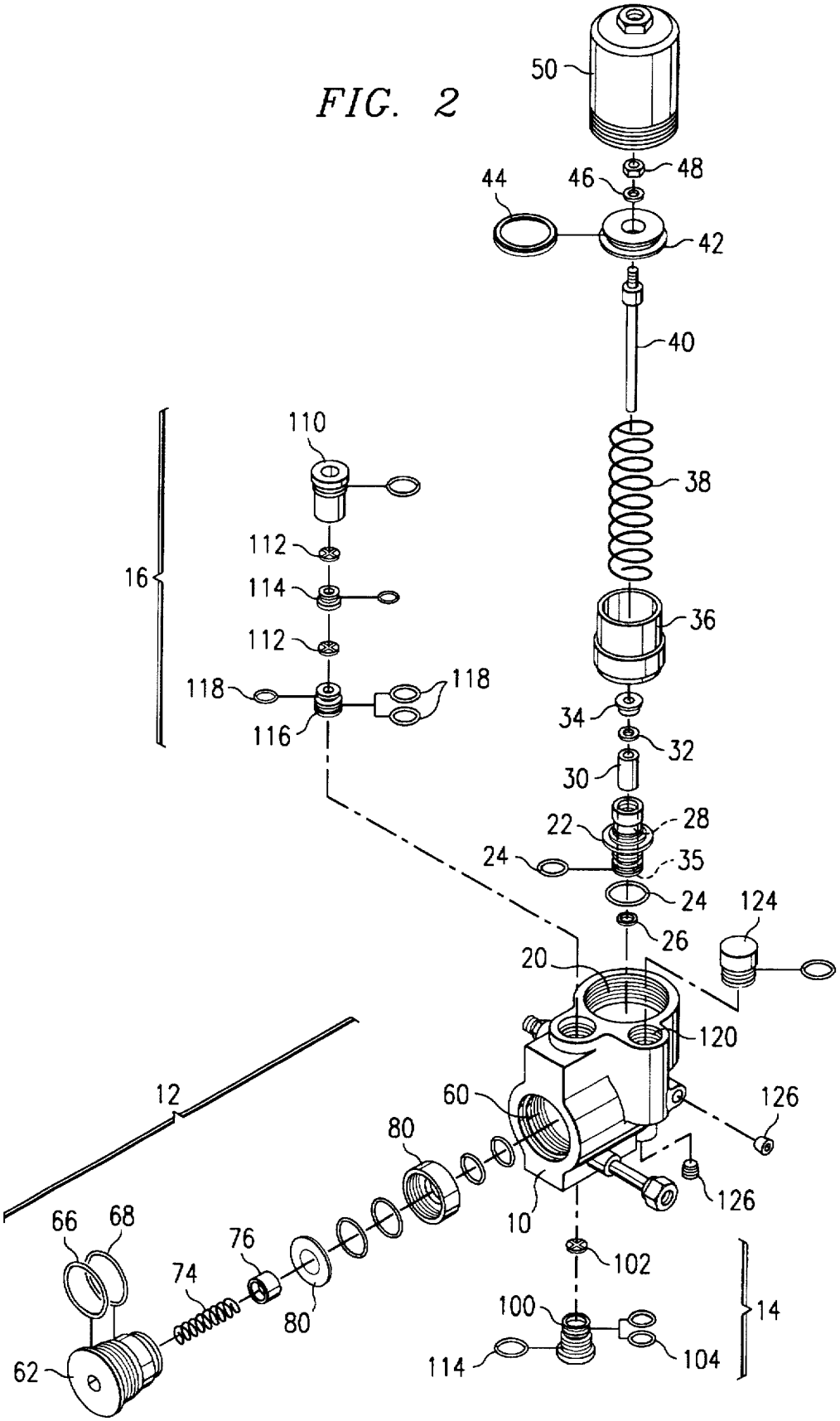
FIG. 2 is an exploded perspective of view of a pump assembly including modular diaphragm and check valve cartridges.

Referring now to the drawings and more particularly to FIGS. 1 and 2, there is illustrated the modular pump assembly of the present invention. The pump assembly comprises a pump housing 10, modular diaphragm cartridge 12, an inlet check valve cartridge 14, discharge check valve cartridge 16 and an actuation piston assembly 18 including a modular plunger seal/guide cartridge 22. Additionally, the pump housing includes an oil reservoir 120 enclosed by oil cap 124 and drain plugs 126.

The actuation piston assembly 18 inserts within the actuation piston chamber 20 of the pump housing 10. The actuation plunger seal/guide cartridge 22 fits within the actuation piston chamber 20 carrying a pair of O-rings 24. Within a central channel 28 of the cartridge 22 fits the plunger guide bushing 30 and an upper plunger seal 32. The cartridge 22 and channel 28 are enclosed by cartridge nut 34. Lower chamber 35 within cartridge 22 encases lower plunger seal 26. A plunger 40 slides within the plunger guide bushing 30 within the interior channel 28 of the cartridge 22. The plunger seal/guide cartridge 22 is threaded into the pump housing 10 as a single unit to provide for easy maintenance.

On the upper end of the ceramic plunger 40 is connected a piston 42 by piston nut 48 and star washer 46. A stroke limiting spacer 36 slides around the exterior of the cartridge 22 to limit the stroke length of the piston 42, and an actuation piston return spring 38 biases the piston to a predetermined position. The piston 42, stroke spacer 36 and spring 38 are within the actuation cylinder 50 which threadedly engages the upper edge of actuation piston chamber 20.

Figure 3:
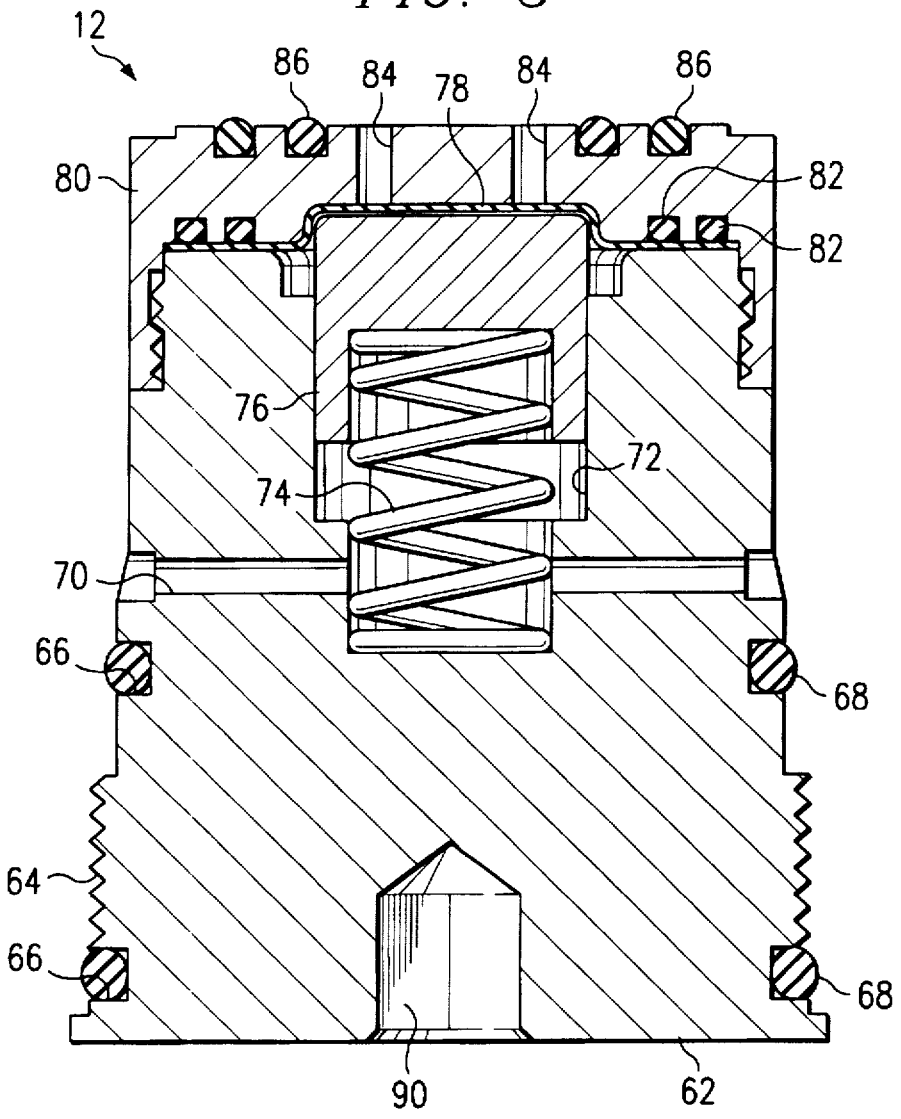
FIG. 3 is a cross sectional view of the modular diaphragm cartridge used in the pump assembly of FIG. 1.

Referring now also to FIG. 3, there is illustrated a cross sectional view of the modular diaphragm cartridge 12 of the pump assembly. The modular diaphragm cartridge 12 consists of an assembly which may be removed from the diaphragm cartridge chamber 60 of the pump housing 10 and replaced as a single unit. The modular diaphragm cartridge 12 threadedly engages the interior surface of diaphragm cartridge chamber 60 via a threaded portion of cartridge 62.

The modular diaphragm cartridge 12 comprises an annular cartridge portion 62 with which the remainder of the components are either inserted or connected. The cartridge 62 includes a threaded collar 64 enabling connection with the pump housing 10. A pair of exterior channels 66 provide seats for O-rings 68 to ensure a secure seal. Channels 70 provide an interconnection between an inner piston chamber 72 and the diaphragm cartridge chamber 60. Within the piston chamber 72, a spring 74 and piston 76 are inserted. Across the opening of the piston chamber 72 is placed a diaphragm 78 which is biased to a predetermined position by spring 74 and piston 76. The diaphragm 78 and piston 76 are held in place by a retaining cap 80 threadedly engaged with the cartridge 62.

Leakage past the diaphragm is prevented by a pair of O-rings 82 on the inner side of cap 80. The cap further defines channels 84 for receiving actuation fluid being pumped through the pump housing 10 of the pump assembly. Leakage from around the channels 84 is prevented by O-rings 86. The piston 76 causes the diaphragm to rest against the underside of cap 80 due to the bias pressures applied by spring 74. The channels 84 enable actuation fluid flow to the diaphragm in response to downward movement of the actuation piston plunger assembly 18. As this assembly 18 travels downward, actuation fluid is forced through channels 84 which forces diaphragm 78, piston 76, and spring 74 inward in chamber 72. Product fluid is displaced from chamber 72 through interconnect channel 70 into the discharge check valve port 71 of discharge check valve 16. This action comprises one discharge stroke.

As actuation piston/plunger assembly 18 returns to the rest position due to bias pressure by spring 38, diaphragm 78 and piston 76 also return to rest against cap 80 due to bias pressure from spring 74. Product fluid enters chamber 72 through interconnect channel 70 from the inlet check valve port 73 of inlet check valve 14. This action comprises one intake stroke. In an alternative embodiment, the diaphragm may also be self-biasing eliminating the need for the piston and spring assembly. Bore 90 provides for the removal of the modular diaphragm cartridge assembly 12 from the pump housing 10 using an allen wrench.

The modular check valve assemblies consist of the inlet check valve 14 and dual discharge check valve 16. The inlet check valve 14 consists of the inlet check body 100, check wafer 102 and O-ring seal 104. As with the modular diaphragm cartridge, the modular check valve cartridge threadedly engages the pump housing as a single unit. The dual discharge check valve cartridge 16 consists of the cartridge body 110 into which a pair of check wafers 112 are slid on each side of a sleeve 114. The sleeve 114 and check wafers 112 are held in place by a seal nut 116 and leakage around the check valve is prevented by three O-ring seals 118.

It should be appreciated by those skilled in the art that the specific embodiments disclosed above may be readily utilized as a basis for modifying or designing other structures for carrying out the purposes of the present invention. It should also be realized by those skilled in the art that such equivalent constructions do not depart from the spirit and scope of the invention as set forth in the appended claims.

What is claimed is:

1. A modular pump assembly, comprising:

a pump housing;

means for actuating a pumping action connected to the pump housing, the means for actuating including a modular plunger seal/guide cartridge;

a modular inlet check valve assembly connected to the pump housing, the check valve assembly comprising a single modular unit threadedly engaging the pump housing;

a modular discharge check valve assembly connected to the pump housing, the modular discharge check valve assembly comprising a single modular unit threadedly engaging the pump housing; and a modular diaphragm assembly connected to the pump housing the diaphragm assembly being a single modular unit threadedly engaging the pump housing and comprising, a body defining an interior chamber at a first end thereof, a cap engaging the first end of the body to enclose the interior chamber, the cap defining at least one outlet port therein, a diaphragm located between the body and the cap, and means for biasing the diaphragm to a predetermined position.

2. The pump assembly of claim 1 wherein the means for biasing comprises:

a piston slidably engaged with the interior chamber; and a spring for biasing the piston against the diaphragm.

3. A pump assembly, comprising:

a pump housing;

means for actuating a pumping action connected to the pump housing, the means for actuating including a plunger seal/guide cartridge;

an inlet check valve assembly connected to the pump housing;

a discharge check valve assembly connected to the pump housing; and a diaphragm assembly connected to the pump housing, the diaphragm assembly comprising:

a body defining an interior chamber at a first end thereof, a cap engaging the first end of the body to enclose the interior chamber, the cap defining at least one outlet port therein, a diaphragm located between the body and the cap, and means for biasing the diaphragm to a predeteremined position, wherein at least one of the check valve assemblies or the diaphragm assembly are modular and threadedly engaged to the pump housing.

4. The pump assembly of claim 3 wherein the inlet check valve assembly comprises a single modular unit threadedly engaging the pump housing.

5. The pump assembly of claim 3 wherein the discharge check valve assembly comprises a single modular unit threadedly engaging the pump housing.

6. The pump assembly of claim 3 wherein the diaaphragm assembly comprises a single modular unit threadedly engaging the pump housing.

* * * * *